US005466204A

United States Patent [19]

Nearing

[11] Patent Number: 5,466,204

[45] Date of Patent: Nov. 14, 1995

[54] UPPER BODY EXERCISE APPARATUS

[75] Inventor: Charles H. Nearing, Redwood Falls, Minn.

[73] Assignee: Activeaid, Inc., Redwood Falls, Minn.

[21] Appl. No.: 196,575

[22] Filed: Feb. 15, 1994

[51] Int. Cl.[6] ..... A63B 21/062; A63B 23/12

[52] U.S. Cl. ..... 482/102; 482/98; 482/99; 482/100; 482/101; 482/136; 482/908; 601/23; 601/33; 602/4

[58] Field of Search ..... 482/69, 98–103, 482/127, 136, 146, 147; 601/23, 33, 35; 602/4; 104/46; 212/222, 253

[56] References Cited

U.S. PATENT DOCUMENTS

| | | | |
|---|---|---|---|
| 2,631,582 | 3/1953 | Bensfield . | |
| 3,077,613 | 2/1963 | Mayer . | |
| 3,373,993 | 3/1968 | Oja et al. . | |
| 3,856,297 | 12/1974 | Schnell . | |
| 4,721,303 | 1/1988 | Fitzpatrick | 482/99 |
| 4,878,663 | 11/1989 | Luquette | 482/100 |
| 4,898,381 | 2/1990 | Gordon | 482/103 |
| 5,102,121 | 4/1992 | Solow et al. | 482/94 |

FOREIGN PATENT DOCUMENTS

| | | | |
|---|---|---|---|
| 090727 | 12/1967 | France | 482/100 |

OTHER PUBLICATIONS

Catalog insert describing Activeaid's "Deltoid–Aid" Model 702 arm counterbalance apparatus, 1986.

Catalog insert describing Activeaid's "Deltoid–Aid" Model 700ACS arm counterbalance apparatus, Feb. 17, 1993.

Activeaid invoice No. 38112 showing 1st sale of Model 700 "Deltoid–Aid", Mar. 5, 1993.

Ellison, Patricia L., *The O.B. Help Arm*, 1971. pp. 1–20.

*Primary Examiner*—Richard J. Apley
*Assistant Examiner*—Victor K. Hwang
*Attorney, Agent, or Firm*—Robert C. Baker; Jeffrey A. Proehl

[57] ABSTRACT

The exercise apparatus is for supportively aiding a patient's therapeutic upper limb movements and rehabilitation of those corresponding muscles. A skeletal frame has two exercise assemblies mounted on it. Each exercise assembly has a substantially horizontal boom, a first weight resistance assembly in depending relationship to the rearward end of said boom, a flexible connecting line extending from the first weight assembly and then along the boom to a sling for a patient's upper limb, and a depending leg to which the boom is pivotally mounted at its rearward end for pivot swinging adduction and abduction movement of the boom. An adjustable stop system is associated with the boom pivot mounting and permits step-wise setting of stop limits for the adduction and abduction pivot swinging movement of the boom. The flexible connecting line does not extend across the axis for the pivot of the boom. Color coded connecting lines for different slings and weight assemblies are used. Torsion resistance adjustability is provided to vary the resistance to adduction and abduction pivot swinging movement of the boom. A spring-biased locking pin is used to set the stop limits for the movement of the boom.

36 Claims, 3 Drawing Sheets

UPPER BODY EXERCISE APPARATUS

BACKGROUND OF THE INVENTION

This invention relates to exercise apparatus for supportively aiding a patient's therapeutic upper limb movements, and more particularly to apparatus of that type equipped with reliable and easily adjustable means for varying the limits of a patient's muscle movements.

Rehabilitation of the function of a patient's upper limbs after an injury will almost always include apparatus-aided therapeutic exercise for the abduction and adduction of the patient's upper limbs and shoulders (e.g., those muscles of the upper body that effect generally lateral movement of the arms away from and toward the vertical axis of the body). Imposing special limits on the permissible extent or range of the patient's abductive and adductive limb movements during the rehabilitation process generally is advisable so as to prevent further injury or to promote strengthening of targeted muscles. These limits and others determined to be desirable by a therapist may be maintained the same over a period of time or may be gradually expanded or contracted (to allow a greater or lesser range of limb movement), with or without varying the resistance/assistance to movement, as the patient heals and strength returns.

Apparatus of this general type has typically employed a boom situated above each of the patient's upper limbs. A dependent line (and attached arm or hand sling) is suspended from each boom to provide support for the limb below. Known apparatus having means for setting limits to the range of assisted or supported lateral arm movements has permitted infinitesimal variation of the limit settings but at sacrifice of the ease and speed of adjustment. Reliance on friction to hold the relationship between parts governing the limit settings for lateral arm movement has its uses, but it requires a rotary tightening step that takes time. Also, friction held settings are not quickly and easily and reliably duplicated (or reliably varied) from day to day. This problem is encountered by therapists serving multiple patients in a large institution. Quick adjustability would be desirable.

SUMMARY OF THE INVENTION

The invention provides new quickly adjustable apparatus for supportively aiding a patient's therapeutic upper limb movements. The new apparatus comprises a skeletal frame and two exercise assemblies mounted on the frame. Each exercise assembly has a substantially horizontal boom having a rearward end and a forward end. A first vertically movable weight-resistance assembly is associated in depending relationship to the rearward end of the boom. Primary guide members are carried on the boom and include at least a first rearward guide and a first forward guide. A first flexible connecting line has a rearward end fastened to the first weight assembly and a terminal forward end adapted to receive means for supporting the upper limb of a user patient. This line is oriented to extend upwardly from the first weight assembly and then be guided along the horizontal boom by the primary guide members. The boom at its rearward end is pivotally mounted to a depending leg for pivot swinging adduction and abduction movement of the boom in a horizontal plane about a generally vertical axis at its pivot mounting. Associated with the boom pivot mounting is an adjustable stop means for step-wise setting of stop limits for the adduction and abduction extent of the pivot swinging movement of the boom.

In combination with the above are other features such as an adjustable torsion resistance means associated with each leg of the exercise assembly for imparting a variable resistance to the pivot swinging movement of the boom. Further, the relationship of the boom to the first depending weight resistance assembly is such that the pivot swinging movement of the boom is not transmitted to that weight resistance assembly. In addition, the relationship of the first flexible connecting line to the pivot mounting for the boom is such that the first line never extends across the vertical axes of the boom pivot mounting. A second connecting line between a limb support and a second weight assembly is coded to be distinguishable from the first line so as to permit easy association of each weight assembly with the limb support connected to it.

Still other advantages, benefits, and features of the composite apparatus of the invention will be evident as this description proceeds.

DESCRIPTION OF THE PREFERRED EMBODIMENT

Figure 1:
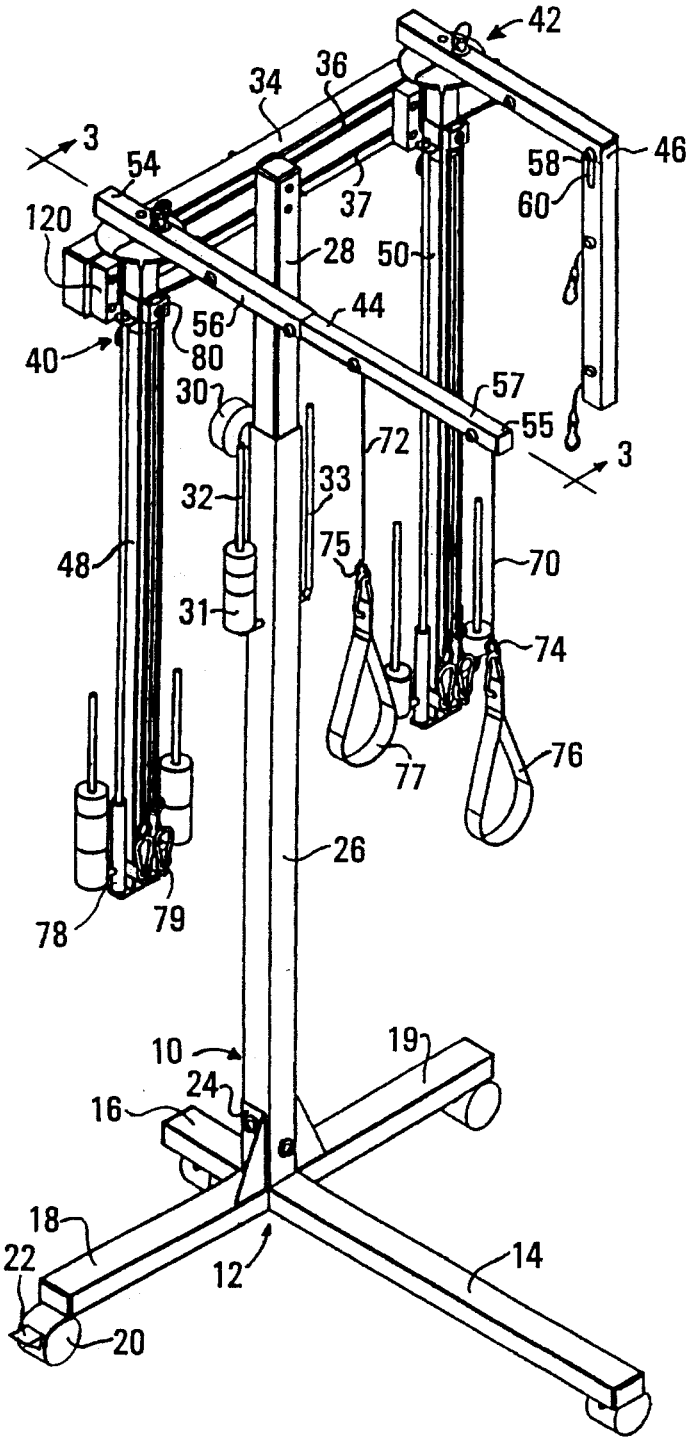
FIG. 1 is a schematic perspective view of the rehabilitation apparatus of the invention.

Referring to FIG. 1, the rehabilitation apparatus of the invention broadly comprises a skeletal frame 10 that supports a first exercise assembly 40 and a second exercise assembly 42.

The skeletal frame 10 has a carriage portion 12 that functions as the movable base or foundation of the rehabilitation apparatus. It has a forward-extending longitudinal member 14 and a rearward-extending member 16 with left 18 and right 19 members that extend laterally from (and in a direction essentially transverse to) the forward 14 and rearward 16 members. The forward-extending member 14 is generally of greater length than the rearward and the lateral members, so as to save the device from being tipped over in a forward direction during use. A swivelable caster 20 is suitably mounted on the distal end of each projecting leg member 14, 16, 18, 19 of the carriage portion; and a braking system to prevent roll of the carriage is provided. For example, each caster 20 may be individually lockable against wheel rotation by a foot-actuated caster locking lever 22.

The carriage portion 12 supports a vertical upright standard most preferably comprised of a vertically oriented lower tube part 26 and an upper rod or column part 28. The lower tube 26 suitably has a hollow square cross-section and has its lower end at a brace 24 fixed at the intersection of the leg members of the carriage 12. The upper column rod 28 is slidingly inserted into the tube 26 to permit vertical extension of the upright standard 28 to a desired height above the carriage portion 12. For securing the column rod part 28 at a desired vertical extension, a securing knob 30 is fixed to a threaded rod that is threadedly mounted in the column 28 through a longitudinal slot in the tube 26. Rotation of the threaded rod by the knob 30 tightens the knob against the tube 26 to create a frictional locking condition between the column rod 28 and the wall of the tube 26 to hold the vertical parts of the upright standard in position. Cylindrical weights 31 not being used on the exercise assemblies 40, 42 may be stored on weight storage spindles 32, 33 mounted on opposite lateral sides of the tube 26.

The final part of this basic frame or skeleton is the horizontal transverse beam 34. It is mounted on the upper end of the upright standard rod 28. Horizontally extending upper 36 and lower 37 longitudinal mounting slots (see FIGS. 1 and 2) are formed in the forward face of the beam 34, and each horizontal slot has a generally C-shaped cross-sectional configuration adapted for use in mounting each of the composite exercise assemblies 40, 42 to the skeletal frame at the transverse beam 34.

First 40 and second 42 exercise assemblies are preferably supported on the transverse beam 34 on opposite lateral sides of the upright standard. Each exercise assembly is suitably a mirror image of the other. The first exercise assembly 40 has a horizontal boom 44 (i.e., first boom) and a depending leg 48 (i.e., first leg). Similarly, the second exercise assembly 42 has a horizontal boom 46 (the second boom) and a depending leg 50 (the second leg). For convenience, features of the first exercise assembly 40 will be described in detail with the understanding that in the preferred embodiment the features of the second exercise assembly 42 are essentially similar (and may be identical) to the first exercise assembly 40.

The first horizontal boom 44 is shown in FIG. 1 in a forward-extending neutral or centered position that is substantially perpendicular to the transverse beam 34. The boom 44 has a rearward end 54 which is substantially adjacent or proximate to the beam 34 and a forward end 55 which is cantilevered out with respect to the beam 34 in a forward direction generally parallel to and elevated over the carriage forward member 14.

Figure 2:
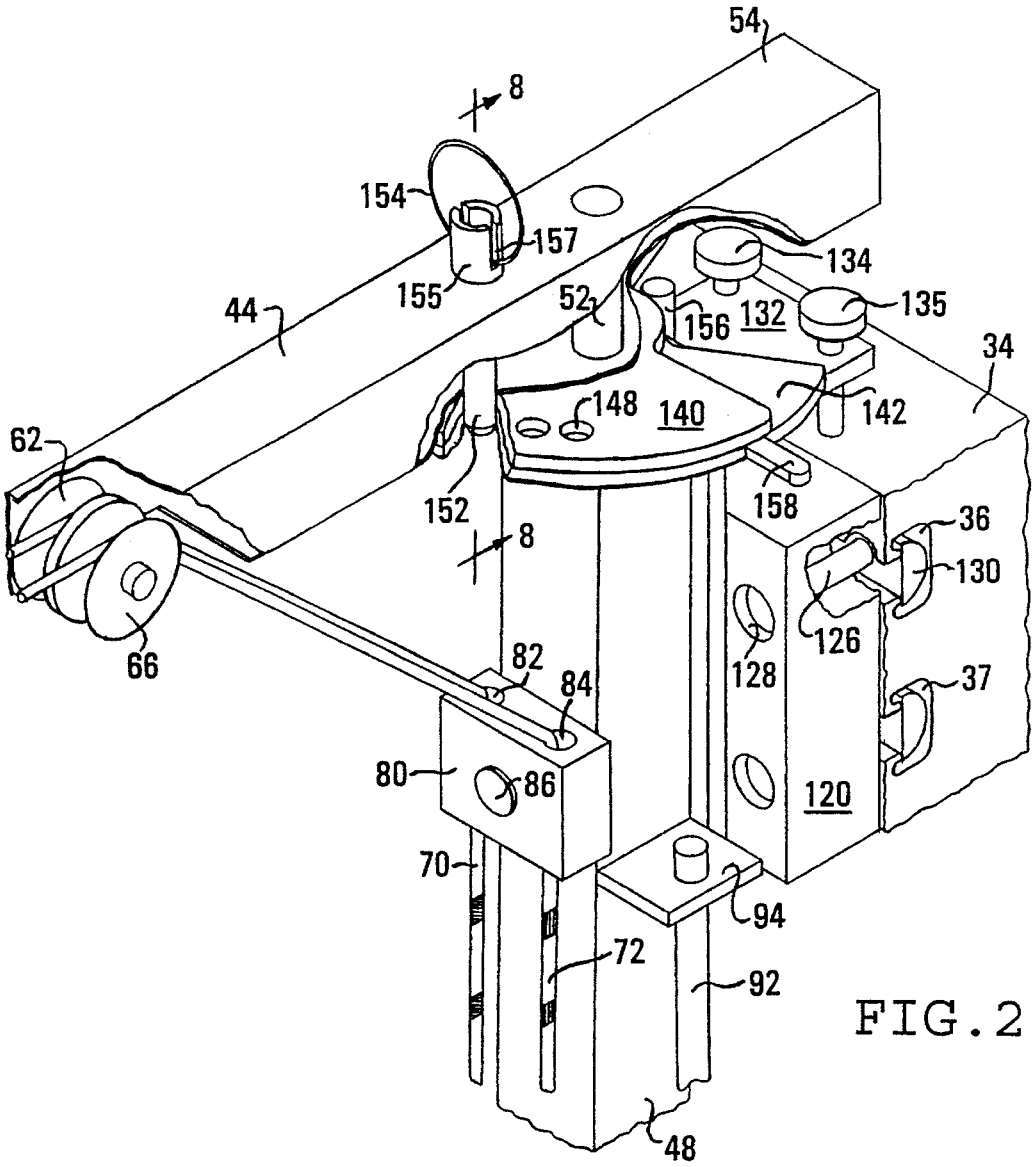
FIG. 2 is a schematic perspective view of the pivot mounting portion between a horizontal boom and the associated depending leg of an exercise assembly of the invention, with parts broken away to show underlying detail.

As shown in FIG. 2, the first horizontal boom 44 is pivotally mounted (for horizontal pivoting) at or near its rearward end to its depending leg 48 (first leg) by means of a vertical pivot shaft 52. The pivot mounting to the leg 48 permits pivot swinging adduction and abduction movement of the boom 44 from the neutral position. This movement is in a substantially horizontal plane and the pivot is at the generally vertical axis of the pivot shaft 52. The pivot mounting between the boom 44 and the leg 48 does not permit pivot swinging movement of the boom 44 to be transmitted to the leg 48.

The horizontal boom 44 is preferably comprised of two square tubular sections, a rearward section 56 and a forward section 57. The forward section 57 of the boom is designed so that the rearward end of the forward section 57 may be slidably inserted into the forward end of the rearward section 56. When inserted, the respective portions are locked in line (i.e., are locked against pivot shift relative to each other). A laterally extending pin 58 is mounted in the interior of the forward end of the rearward section 56. A longitudinal slot 60 in the rearward portion of the forward section 57 rides or slides on the pin 58 during slide insertion or extension of the forward section 57. As shown by the horizontal boom 46 of the second exercise assembly 42 in FIG. 1, when the forward section is pulled out or withdrawn from the rearward section, the forward section may pivot on the pin 58 down to a substantially vertical depending or collapsed position which reduces the protrusion of the boom for convenient storage of the apparatus.

Figure 3:
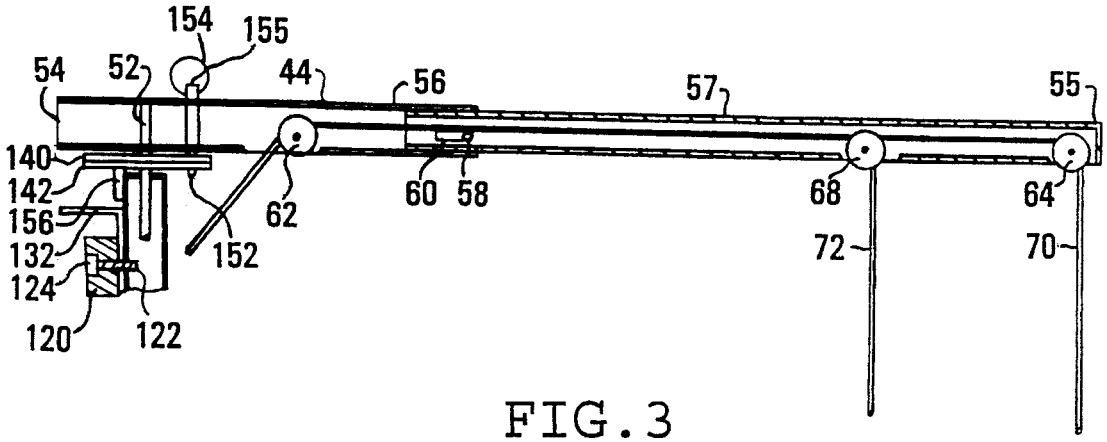
FIG. 3 is a schematic sectional view, taken along line 3—3 of FIG. 1, and showing internal details for the horizontal boom and a portion of the depending leg of an exercise assembly of the invention.

Turning to FIGS. 2 and 3, with particular attention to FIG. 3, primary guide members are carried on the boom 44 and include a first rearward guide 62 and a first forward guide 64, preferably pulleys. The guide pulleys are mounted substantially inside the tubular sections of the boom 44 and turn on shafts fixed to the sides of the tubular boom sections. Preferably, secondary guide members are also carried on the boom 44 and include a second rearward guide 66 and a second forward guide 68. The second rearward 66 and second forward 68 guides are laterally spaced with respect to the first rearward and forward guides. Like the first guides, these second guides in the first exercise assembly comprise pulleys mounted on shafts fixed to sides of the tubular boom.

The first forward pulley 64 is preferably carried at the most forward portion of the forward section 57 (e.g., at or near the forward end 55) of the boom 44. The second forward pulley 68 is spaced rearwardly from the first forward pulley 64 on the forward section 57 while still being forward of the first and second rearward pulleys 62, 66. Rearward pulleys 62, 66 are preferably located in the rearward section 56 of the boom 44 and are most suitably equally spaced, and forwardly of, the pivot mounting 52. Rearward pulleys 62, 66 suitably turn upon the same shaft (see FIG. 2).

A first flexible connecting line 70 (e.g., a nylon or poly cord or rope or cable) is guided along the boom 44 by the pulleys 62, 64 of the primary guide members (see FIGS. 2 and 3). Similarly, a second flexible connecting line 72 is guided along the boom 44 by the pulleys 66, 68 of the secondary guide members. The first connecting line has a terminal forward end 74 that depends from the first forward pulley 64 and is adapted to receive means for supporting (at a location below the boom 44) the upper limb or a portion of the arm or hand of a patient using the apparatus. Such supporting means may comprise a first sling 76 as shown in FIG. 1. Similarly, the terminal forward end 75 of the second connecting line 72 depends from the second forward pulley 68 and is adapted to receive a second sling 77 or similar means for supporting a part of a user's limb.

Figure 5:
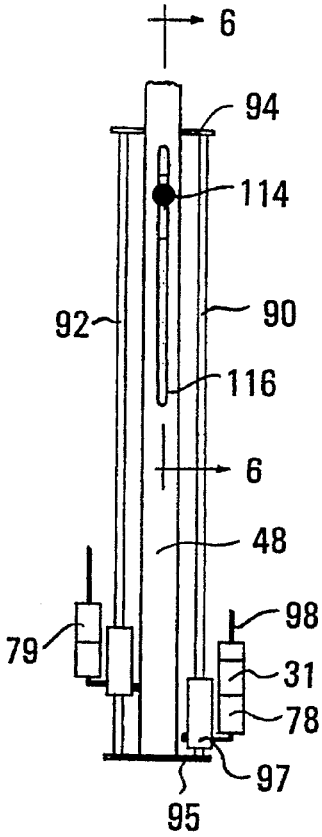
FIG. 5 is a schematic view of the rear of a portion of a depending leg of an exercise assembly of the invention and shows the weight assemblies associated with the leg as well as part of the torsion resistance adjustment.

The rearward end of the first connecting line 70 is fastened to the first weight resistance assembly 78 (see FIGS. 1 and 5), which depends below the rearward end of the boom 44 and is preferably mounted on the leg 48 in a manner allowing vertical movement of the first weight assembly as caused by linear movement of first connecting line 70. The rearward end of second connecting line 72 is fastened to weight resistance assembly 79 for similar function.

The first weight assembly 78 (see FIG. 5) is preferably supported and guided by elements mounted on the depending leg 48. Mounted on one lateral side of the depending leg 48 is a first vertical track rod 90 for guiding the first weight assembly along the leg 48. On the other lateral side of leg 48 is a second vertical track rod 92 for guiding the second vertically movable weight assembly 79 along the leg 48. The rod-like tracks 90, 92 are mounted in a parallel, spaced relationship to the leg 48 by upper 94 and lower 95 track support brackets.

Illustratively a sleeve 97 slides on the first track rod 90, which guides vertical movement of the weight assembly 78 attached to the first connecting line 70. Fixed to sleeve 97 is a weight holding spindle 98 on which weights 31 may be loaded to apply the desired amount of tension to the first line 70 and thus provide lifting or supporting force to the first sling 76. A fastening ear (not shown) fixed to the sleeve 97 of first weight assembly 78 has a hole for receiving a releasable fastening hook of first line 70. The second weight assembly 79 is constructed similarly to assembly 78 and is fastened to second line 72. Assistive support of the user's limbs comes from the counterbalancing effect of the weight resistance assemblies.

When both first 70 and second 72 connecting lines are employed on an exercise assembly, it is preferable to make one line visually distinguishable in appearance from the other line. This feature facilitates visual association (by a person adjusting the apparatus) between the rearward and forward ends of the same line so as to distinguish one line from the other at its various portions. For example, when the first line 70 has a distinct appearance from the second line 72, a visual association between the first weight resistance assembly (connected to the first line's rearward end) and the first sling 76 (connected to the first line's forward end 74) is created which aids in adjusting the correct weight resistance for the particular sling desired to be balanced. A preferred manner for visually distinguishing the respective lines is through the use of differently colored cords for each line. The illustrative embodiment uses cords of the same background color with each line having a stripe of a different color (e.g., one line has a blue stripe and the other line has a red stripe). Tactilely distinguishable (i.e., through finger touch) cords or lines may also be useful. Thus, sense-wise distinguishability, whether visually or tactilely is a beneficial and useful feature.

Since the pivot swinging adduction and abduction movement of the boom 44 is not transmitted to the leg 48 and does not cause pivot shift of the weight assembly mounted on the leg 48, any horizontal pivot movement of the boom from the neutral position forces the lines 70, 72 into an angularly changing path as the lines span from the boom 44 to the leg 48.

Figure 4:
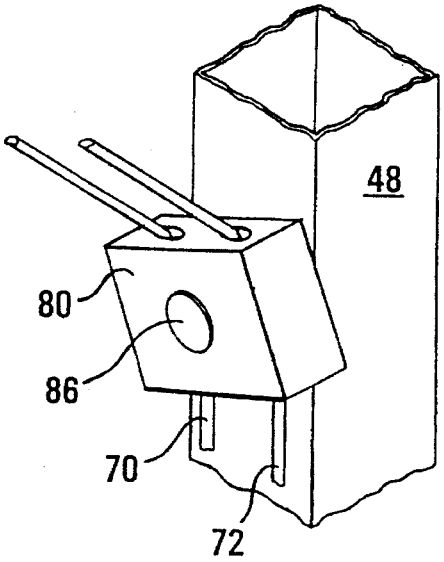
FIG. 4 is a schematic perspective view of a swivel keeper member and its mounting on a depending leg (mostly broken away) of an exercise assembly.

A line keeper member 80 is mounted at the forward upper portion of the depending leg 48 (see FIGS. 2 and 4) and reduces the chance that the lines 70, 72 might bind or become untracked (which might occur if pulleys were used at this location). The keeper 80 keeps the lines spaced during the boom's pivot swinging movement. A block-shaped keeper 80 equipped with parallel first 82 and second 84 channel guides or holes through the member 80 is useful to guide the first 70 and second 72 connecting lines, respectively, along the depending leg 48.

Most preferably, the keeper member 80 is mounted to the leg 48 by a bolt or horizontal axis shaft 86 which permits the keeper member to tilt or swivel about the horizontal axis 86. As the boom 44 is swung, the upper surface of the keeper member tilts laterally toward the general direction of the pivot swinging movement of the boom 44. The tilting of the keeper member tends to better align the channels or holes 82, 84 of the keeper with the path of the connecting lines as the boom 44 swings, and thereby reduces the angular severity or sharpness of the bends imposed upon the connecting lines 70, 72 as they enter and exit the channels or guide holes of the keeper member 80. Less sharpness in these bends reduces the frictional resistance to the movement of the lines through the channels (which must be overcome by the patient) and also reduces physical wear on the lines. The ideal keeper members are plastic (e.g., any suitable strong and low-friction, filled or non-filled plastic such as nylon, polycarbonates, methacrylates, and even possibly polyethylene).

The rehabilitation apparatus also preferably includes an adjustable torsion resistance means on the depending leg 48 for imparting a variable resistance to the pivot swinging movement of the boom 44. The torsion resistance means resists pivot swinging movement by the boom from the neutral or centered position (i.e., perpendicularly outward from the skeletal frame) to a laterally outward or inward (e.g., right or left) position. Such resistance to pivot of the boom imparts resistance to a patient's arm movements; and this helps to strengthen the muscles responsible for abduction and adduction movement. In the embodiment illustrated, once the torsion resistance is adjusted to the desired variable resistance level, the resistance to the pivot swinging boom movement progressively increases as the boom is swung by the patient's arm movement further from its neutral position.

Figure 6:
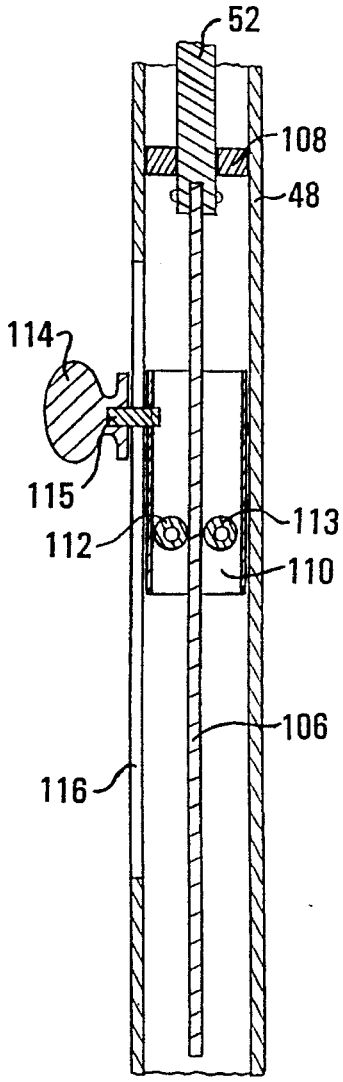
FIG. 6 is a schematic sectional view of a portion of the depending leg of an exercise assembly, taken along line 6—6 of FIG. 5, and shows the torsion resistance feature of the invention.

The preferred torsion resistance means (shown in FIG. 6) includes a flat torsion spring 106 which is fixed to the lower end of the pivot shaft 52 so as to depend within the interior of the tubular depending leg 48. Of significance is the fact that boom 44 is fixed to pivot shaft 52 and causes rotation of shaft 52 when the boom is pivoted in adductive and abductive movement. Thus, as the pivot shaft 52 is rotated (within the leg bushing 108) by the pivot swinging movement of the boom, the torsion spring 106 is forced to rotate. A slider member 110 slidable within the interior of the leg 48 may be adjustably secured at various positions along the length of the spring 106. Pinching rollers 112, 113 carried inside the slider 110 snugly contact the opposite faces of the spring 106 to resist rotation by the spring at the point of their contact. A slider securing knob 114 (shown in FIGS. 5 and 6) has a threaded post 115 which passes through a longitudinal slot 116 in the wall of the depending leg 48 and threadedly mounts to a wall of the slider 110. Hand turning of the knob 114 tightens the slider 110 and knob 114 together, pinching each against the wall of the leg 48, and secures the position of the slider along the length of the torsion spring 106. The torsion spring 106 is preferably formed of spring steel (e.g., like a clock spring) and slider 110 functions to increase or decrease the length of the spring 106 that may be effectively twisted by rotation of the pivot shaft 52. The shorter the effective length of the spring 106, the greater the resistance applied to the rotation of the pivot shaft 52, and thereby to the pivot swinging movement which is felt by the patient attempting to swing the boom via his or her arm movements. The width of the spring 106 is preferably significantly reduced at its lowermost end so that at the lowermost position of the slider 110, the spring is allowed to rotate virtually without resistance between the pinching rollers 112, 113 (while remaining pinched between the rollers).

The first exercise assembly 40 is preferably mounted on the skeletal frame 10 at the first depending leg 48 of the assembly 40, and most preferably mounted at an upper portion of the leg 48. An assembly mounting block 120 (see FIGS. 1, 2, and 3) is located between the depending leg 48 and the transverse beam 34. A mounting bolt 122 (see FIG. 3) extends through a central hole 124 in the mounting block 120 and is threadedly fixed to the rearward wall of the depending leg 48. The bolt 122 forms a horizontal axis and is sufficiently loose against the mounting block 120 to permit the leg 48 to laterally tilt about that horizontal axis. Thus the leg is laterally tiltable with respect to the mounting block 120. The tilt is in the transverse vertical plane in which the depending legs 48, 50 of the first 40 and second 42 exercise assemblies lie.

An L-shaped shoulder plate 132 (shown in FIGS. 2 and 3) is immovably fixed to the depending leg 48 between the leg and the mounting block 120 and extends as a rearward platform from the leg above the mounting block 120 and above the transverse beam 34. Two laterally spaced thumb screws 134, 135 threaded through holes in the shoulder plate 132 may be turned to abut and bear on the upper surface of the beam 34. Screws 134 and 135 are laterally spaced about equally on opposite lateral sides of the horizontal axis bolt 122. Withdrawing the screws 134, 135 from abutment with the beam allows the first exercise assembly 40 to be tilted (about the horizontal axis bolt 122) in the transverse vertical plane relative to the mounting block 120. When the desired degree of lateral tilt of the assembly 40 is achieved, the thumb screws are threaded into abutment against the upper surface of the beam which locks the exercise assembly in the tilted position. The ability to tilt the exercise assemblies in a vertical transverse plane allows the patient to pull against the constant weight assembly (e.g., gravitational) resistance not only in a vertical direction down from the boom 44 but also in more lateral directions or off-vertical directions—thus to vary the exercise of the patient's abductor and adductor muscles. Exercise of the abductor and adductor muscles of a patient using the apparatus may be conducted against the constant resistance force applied by the weight resistance assemblies and also may be conducted against the progressively increasing resistance force applied by the torsion resistance means. Various combinations of resistance are possible.

Four beam mounting bolts 126 each extend through respective bolt holes 128 in mounting block 120. A pair of laterally spaced bolts 126 will protrude into each of the longitudinal slots 36, 37 in the beam 34. Semicylindrical anchor nuts 130 are lodged within the generally C-shaped slots 36, 37 to receive the threaded ends of the beam mounting bolts 126. When the bolts 126 are slightly loosened, the exercise assembly 40 may be laterally shifted along the slots 36, 37 of the beam 34 for the purpose of tailoring the spacing between the first 40 and second 42 exercise assemblies to the approximate width of a particular patient's shoulders (e.g., adapting the apparatus for use by adults and children).

A significant feature of the invention is the adjustable stop means for setting stop limits to the extent of the pivot swinging movement of the boom 44. The extent or range of the boom's pivot swinging movement from the neutral position toward the lateral directions may be adjustably limited between several discrete step-wise incremental settings.

Figure 7:
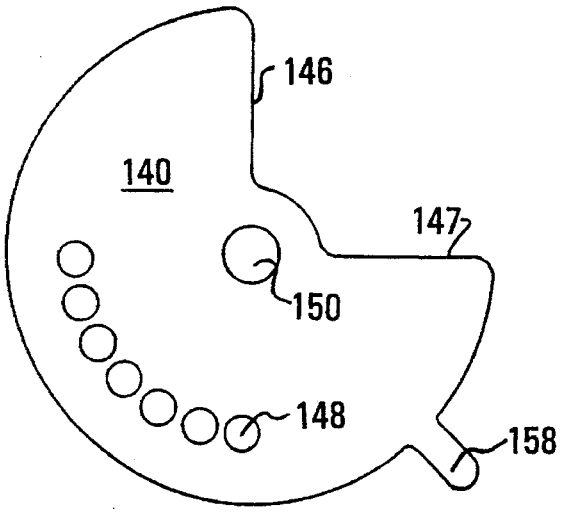
FIG. 7 is a schematic top plan view of a circular disk plate used in the step-wise limit means for the extent of pivot swinging adduction and abduction movement of the boom of an exercise assembly of the invention.

In the preferred embodiment, the means for setting the step-wise stop limits (see FIG. 2) include an upper plate 140 and a lower plate 142 that are most suitably formed by essentially circular disks (illustrated in FIG. 7). The structural features of the upper 140 and lower 142 disks are substantially similar to each other (except for finger tabs such as at 158; such tabs are located on opposite lateral sides of the respective disks when installed on the apparatus). The preferred disks are made of a transparent material (such as polymethyl methacrylate or Plexiglas or any other suitable plastic) that enhances the user's ability to properly position the disks relative to each other in the manner described below.

The upper 140 and lower 142 disks each have an essentially pie-shaped void sector between radially extending edges 146, 147 (see FIG. 7). The angular size of the smallest void sector sets the maximum adjustment possible for the extent of pivot swinging movement for the boom. The disk of the illustrative embodiment has a sector with an angular measurement of about 90 degrees, but this angle can be larger or smaller depending upon the maximum possible pivot swinging movement range desired.

Disks 140, 142 have a central pivot hole 150 suitable for receiving the pivot shaft 52 of the pivot mounting between the boom 44 and the leg 48. As shown in FIG. 2, the disks 140, 142 are placed in a stacked relationship to each other (e.g., the upper disk lies upon the lower disk) on the pivot shaft 52 so that the disks can rotate about the same vertical axis of the pivot mounting as the boom 44.

A plurality of apertures 148 in each disk 140, 142 (shown in FIG. 7) are equally radially spaced (in circumferential alignment) from the pivot hole 150 so that rotation of the stacked, mounted disks relative to each other allows an aperture in the upper disk 140 to be moved into registry or alignment with an aperture in the lower disk 142. In the illustrative embodiment, seven apertures are equally angularly spaced at about 15 degrees from each other for a total range (between extremes) of about 90 degrees. The angular spacing between apertures can be larger or smaller or non-uniform and the total range can be increased or decreased. The angle for the total range generally corresponds to the angular size of the void sector.

On opposite sides of the void sector of the disk are radial edges or stop edges 146, 147. When the disks are mounted on the pivot shaft 52, one (active) stop edge acts to stop or limit the pivot swinging movement of the boom in one lateral direction (while the other stop edge on that disk has no effect in that direction). The other (active) stop edge acts to stop the boom pivot swinging movement in the opposite direction and the other stop edge on that disk has no effect in that direction. Rotation of the disks relative to each other about the pivot shaft 52 moves the active stop edges on the upper and lower disks closer together or farther apart, and the angular gap between the stop edges corresponds to the maximum angular extent of boom pivot swinging movement permitted by those particular stop limit settings.

The means for setting the stop limits also includes means for locking the disks against rotational movement relative to each other and means for locking the disks against rotational movement relevant to the boom. In the preferred embodiment (see FIGS. 2, 3, and 8), the locking means comprises a locking pin 152 mounted on the boom 44 at a radial spacing distance from the pivot shaft 52 that is equal to the spacing of the apertures 148 from the pivot shaft. This location allows the locking pin 152 to penetrate through an aperture in each disk once the apertures are registered in a position below the locking pin. The locking pin 152 is biased to project from the lower wall of the boom and through the registered apertures. The locking pin 152 may be retracted from its projecting condition by a finger pulling on the pull ring 154, which frees the disks for rotation relative to each other for moving other apertures into registration and setting the angular gap between active stop edges.

Figure 8:
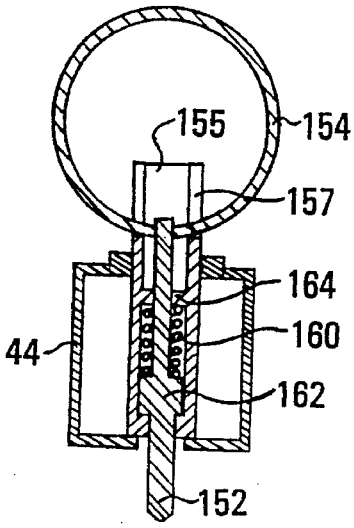
FIG. 8 is a sectional view taken along line 8—8 of FIG. 2.

Referring to FIG. 8 (in combination with FIGS. 2 and 3), a locking pin collar 155 has a slot 157 therein that accommodates the pull ring 154 when the locking pin 152 projects from the lower wall of the boom. Pulling the pull ring 154 out of the slot 157 and above the collar 155 permits rotation of the ring such that the ring catches or rests on the collar and holds the locking pin 155 in a retracted position. The locking pin is then released by rotating the pull ring 154 back to a position above the slot 157. When the ring 154 is in position to pass into slot 157, spring 160 pulls the ring 154 into the slot 157. This occurs because spring 160 was compressed against tube shoulder 164 by the action of pin shoulder 162 when the ring 155 was lifted from slot 157. The result of this relationship is that pin 152 is spring-biased toward a locking position in apertures of the plates 140 and 142.

The means for setting stop limits according to the invention also includes stopping means. In the preferred embodiment (see FIG. 2), the stopping means comprise a stop pin 156. The stop pin 156 is rigidly mounted on the depending leg 48 at a location radially spaced from the pivot shaft 52 of the pivot mounting. A portion on the stop pin 156 projects upwardly through the plane of the disks 140, 142 and between the stop edges 146, 147 of the disks. Since the stop edges of the disks are locked to the pivot swinging movement of the boom (by means of the locking pin 152), contact between a stop edge and the stop pin 156 stops the pivot swinging movement of the boom at the selected stop limit position.

The step-wise incremental stop limits for the pivot swinging movement of the boom provided by the invention give a therapist quick and easily identifiable discrete stop limits on the selected range of abductive and adductive motion of the patient's arm. Since rehabilitation apparatus of the type described may be used for the concurrent therapy of several patients, selecting the same extent of pivot swinging movement from day to day for different patients is made easier by this system. Also, subsequent therapy sessions may be planned with incremental increases (or decreases) in the stop limits simply by bringing a different aperture into registry below the lock pin at that occasion. The apertures on the disks may be numbered or lettered for easy and quick identification of the apertures to be registered, which enhances the ease of setup of the apparatus for a particular patient.

The locking relationship between the locking pin on the boom and the apertures of the disk does not rely upon simple friction between the plates to hold the stop limit settings and resist the pivot swinging movement of the boom past the set stop limits. The positive locking system of the invention is virtually immune to slippage between the disks induced by patient arm movements that might alter the selected pivot swinging movement limits beyond what is desirable for the patient and lead to injury to the patient.

Those skilled in the art will readily recognize that this invention may be embodied in still other specific forms than illustrated without departing from the spirit or essential characteristics of it. The illustrated embodiment is therefore to be considered illustrative and not restrictive, the scope of the invention being indicated by the appended claims rather than the foregoing description, and all variations that come within the meaning and range of equivalency of the claims are intended to be embraced thereby.

That which is claimed is:

1. Exercise apparatus for supportively aiding a patient's therapeutic upper limb movements, comprising a skeletal frame and two exercise assemblies mounted on said frame, each said exercise assembly comprising a substantially horizontal boom having a rearward end and a forward end, a first vertically movable weight resistance assembly associated in depending relationship to the rearward end of said boom, primary guide members carried on said boom and including at least a first rearward guide and a first forward guide, a first flexible connecting line having a rearward end fastened to said first weight assembly and a terminal forward end adapted to receive means for supporting the upper limb of a user patient, said first line having a portion extending upwardly from said first weight assembly and a portion guided along said horizontal boom by said primary guide members, a depending leg to which said boom is pivotally mounted at its rearward end for pivot swinging adduction and abduction movement of the boom in a horizontal plane about a generally vertical axis at said pivot mounting, adjustable stop means associated with said boom pivot mounting for step-wise setting of stop limits for defining a selected range of adduction and abduction pivot swinging exercise movement of said boom during exercise use of said exercise assembly, and a keeper member mounted on said depending leg and through which said first connecting line is slidably mounted, said keeper member being for guiding the movement of a portion of said first connecting line between said first weight assembly and said first rearward guide.

2. The apparatus of claim 1 wherein said adjustable stop means comprises radially extending stop members, means for moving said stop members in predetermined step-wise increments to vary the outer limits of said pivot swinging adduction and abduction movement of said boom, and locking pin means for fixing said stop members against movement with respect to each other.

3. The apparatus of claim 1 additionally comprising an adjustable torsion resistance means associated with said leg for imparting a variable resistance to said pivot swinging movement of said boom.

4. The apparatus of claim I wherein the relationship of said boom to said first depending weight resistance assembly is such that said pivot swinging movement of said boom is not transmitted to said first depending weight resistance assembly, and wherein the relationship of said first flexible connecting line to said pivot mounting of said boom is such that said first line never extends rearwardly of the vertical axis of said pivot mounting.

5. The apparatus of claim 1 wherein said adjustable stop means comprises two plates mounted about the vertical axis of said pivot mounting of said boom, each said plate being rotationally adjustable about the axis of said pivot mounting and each said plate having a radial stop edge thereon, releasable locking means mounted on said boom for locking the rotational movement of said plates to the pivot swinging movement of said boom and for locking the position of the stop edge on one said plate relative to the stop edge on the other said plate, and stopping means mounted on said depending leg and projecting to a location between the radial stop edges of said plates, said stopping means being for stopping the movement of said boom when a said stop edge abuts said stopping means, wherein said stop edges form an angle therebetween that corresponds to the maximum angular extent of pivot swinging movement for said boom.

6. The apparatus of claim 1 wherein said adjustable stop means comprises two plates mounted about the vertical axis of said pivot mounting of said boom for rotational adjustment movement thereabout, each said plate being equipped with a plurality of apertures radially spaced from the vertical axis of said pivot mounting such that rotational adjustment movement of said plates relative to each other permits registration of a said aperture in one said plate with a said aperture in the other said plate, and a locking pin mounted on said boom and adapted to retractably project through registered apertures of said plates.

7. The apparatus of claim 6 wherein said locking pin is biased toward a locking position within registered apertures of said plates.

8. The apparatus of claim 1 wherein each said exercise assembly additionally comprises a second vertically movable weight resistance assembly associated in depending relationship to the rearward end of said boom, secondary guide members carried on said boom and including at least a second rearward guide and a second forward guide, said second forward guide being rearward of said first forward guide, and a second flexible connecting line having a rearward end fastened to said second weight assembly and a terminal forward end adapted to receive means for supporting the upper limb of a user patient, said second line having a portion extending upwardly from said second weight assembly and a portion guided along said horizontal boom by said secondary guide members, and wherein the relationship of said second flexible connecting line to said pivot mounting of said boom is such that said second line never extends rearwardly of the vertical axis of said pivot mounting.

9. The apparatus of claim 8 wherein one said connecting line is sense-wise distinguishable from the other said connecting line to thereby facilitate association between the rearward and forward ends of said one line and distinguish those ends from the rearward and forward ends of said other line.

10. The apparatus of claim 1 wherein the keeper member of each said exercise assembly comprises plastic material.

11. The apparatus of claim 1 wherein said keeper member is mounted for swivel movement about a horizontal axis to minimize the angular severity of bends in said first connecting line at said keeper member during pivot swinging adduction and abduction movement of said boom.

12. The apparatus of claim 1 wherein each said exercise assembly is mounted on said skeletal frame at the depending leg of said exercise assembly.

13. The apparatus of claim 1 wherein the depending legs of both said exercise assemblies extend entirely in a transverse vertical plane and wherein said first connecting line does not extend rearwardly of said transverse vertical plane.

14. The apparatus of claim 1 wherein the depending legs of both exercise assemblies extend entirely in a transverse vertical plane and wherein each said exercise assembly is mounted on said skeletal frame at a horizontal axis so as to permit an adjustable degree of lateral tilt by said exercise assembly about said horizontal axis.

15. The apparatus of claim 1 wherein said exercise assemblies are mounted on said skeletal frame so as to permit adjustment of the horizontal spatial distance between them.

16. The apparatus of claim 1 wherein said adjustable stop means comprises an upper and a lower plate each having a pivot hole therein, each said plate having a plurality of apertures radially spaced from said pivot hole and having a stop edge radially extending from said pivot hole, the upper one of said plates being stacked upon the lower one of said plates with the vertical axis of said pivot mounting passing through the pivot holes of the stacked plates to permit pivot movement of each said plate independent of the pivot swinging movement of said boom, the stop edge of said upper plate and the stop edge of said lower plate forming a gap therebetween with the distance separating said stop edges defining the size of said gap, wherein pivot movement of said upper plate relative to said lower plate permits registration of a said aperture in said upper plate with a said aperture in said lower plate and permits the size of said gap to be adjusted, a retractable locking pin mounted on said boom at a location radially spaced from said vertical pivot axis and biased to project through a said aperture in said upper plate in registry with a said aperture in said lower plate to lock said plates against rotational movement with respect to each other, and a stop pin mounted on said depending leg at a location radially spaced from said vertical pivot axis and projecting into said gap to stop the pivot swinging movement of said boom when a said stop edge contacts said stop pin.

17. Rehabilitation apparatus for supportively aiding a patient's therapeutic upper limb movements, comprising a skeletal frame and two exercise assemblies mounted on said frame, each said exercise assembly comprising a substantially horizontal boom having a rearward end and a forward end, a first vertically movable weight resistance assembly associated in depending relationship to the rearward end of said boom, primary guide members carried on said boom and including at least a first rearward guide and a first forward guide, a first flexible connecting line having a rearward end fastened to said first weight assembly and a terminal forward end adapted to receive means for supporting the upper limb of a user patient, said first line having a portion extending upwardly from said first weight assembly and a portion guided along said horizontal boom by said primary guide members, a depending leg to which said boom is pivotally mounted at its rearward end for pivot swinging movement of the boom in a horizontal plane about a generally vertical axis at said pivot mounting, and an adjustable torsion resistance means associated with said leg for imparting a varied degree of resistance to said pivot swinging movement of said boom, wherein the relationship of said boom to said first depending weight resistance assembly is such that said pivot swinging movement of said boom is not transmitted to said first depending weight resistance assembly, and wherein the relationship of said first flexible connecting line to said pivot mounting of said boom is such that said first line never extends rearwardly of the vertical axis of said pivot mounting, and wherein the pivot mounting of said boom has means associated with it for setting variable step-wise stop limits to the extent of said pivot swinging movement of said boom.

18. Exercise apparatus for supportively aiding a patient's therapeutic upper limb movements, comprising a skeletal frame and two exercise assemblies mounted on said frame, each said exercise assembly comprising a substantially horizontal boom having a rearward end and a forward end, a first vertically movable weight resistance assembly associated in depending relationship to the rearward end of said boom, primary guide members carried on said boom and including at least a first rearward guide and a first forward guide, a first flexible connecting line having a rearward end fastened to said first weight assembly and a terminal forward end adapted to receive means for supporting the upper limb of a user patient, said first line having a portion extending upwardly from said first weight assembly and a portion guided along said horizontal boom by said primary guide members, a depending leg to which said boom is pivotally mounted at its rearward end for pivot swinging adduction and abduction movement of the boom in a horizontal plane about a generally vertical axis at said pivot mounting, and adjustable stop means associated with said boom pivot mounting for step-wise setting of stop limits for the adduction and abduction extent of said pivot swinging movement of said boom, wherein said adjustable stop means comprises radially extending stop members, means for moving said stop members in predetermined step-wise increments to vary the outer limits of said pivot swinging adduction and abduction movement of said boom, and locking pin means for fixing said stop members against movement with respect to each other.

19. The apparatus of claim 18 additionally comprising an adjustable torsion resistance means associated with said leg for imparting a variable resistance to said pivot swinging movement of said boom.

20. The apparatus of claim 18 wherein the relationship of said boom to said first depending weight resistance assembly is such that said pivot swinging movement of said boom is not transmitted to said first depending weight resistance assembly, and wherein the relationship of said first flexible connecting line to said pivot mounting of said boom is such that said first line never extends rearwardly of the vertical axis of said pivot mounting.

21. The apparatus of claim 18 wherein each said exercise assembly additionally comprises a second vertically movable weight resistance assembly associated in depending relationship to the rearward end of said boom, secondary guide members carried on said boom and including at least a second rearward guide and a second forward guide, said second forward guide being rearward of said first forward guide, and a second flexible connecting line having a rearward end fastened to said second weight assembly and a terminal forward end adapted to receive means for supporting the upper limb of a user patient, said second line having a portion extending upwardly from said second weight assembly and a portion guided along said horizontal boom by said secondary guide members, and wherein the relationship of said second flexible connecting line to said pivot mounting of said boom is such that said second line never extends rearwardly of the vertical axis of said pivot mounting.

22. The apparatus of claim 18 wherein each said exercise assembly additionally comprises a keeper member mounted on said depending leg for guiding the movement of a portion of said first connecting line between said first weight assembly and said first rearward guide.

23. The apparatus of claim 22 wherein said keeper member comprises a plastic block through which said first connecting line is slidably mounted.

24. The apparatus of claim 23 wherein said keeper member is mounted for swivel movement about a horizontal axis to minimize the angular severity of bends in said first connecting line at said keeper member during pivot swinging adduction and abduction movement of said boom.

25. The apparatus of claim 18 wherein the depending legs of both said exercise assemblies extend entirely in a transverse vertical plane and wherein said first connecting line does not extend rearwardly of said transverse vertical plane.

26. The apparatus of claim 18 wherein the depending legs of both exercise assemblies extend entirely in a transverse vertical plane and wherein each said exercise assembly is mounted on said skeletal frame at a horizontal axis so as to permit an adjustable degree of lateral tilt by said exercise assembly about said horizontal axis.

27. The apparatus of claim 18 wherein said exercise assemblies are mounted on said skeletal frame so as to permit adjustment of the horizontal spatial distance between them.

28. Exercise apparatus for supportively aiding a patient's therapeutic upper limb movements, comprising a skeletal frame and two exercise assemblies mounted on said frame, each said exercise assembly comprising a substantially horizontal boom having a rearward end and a forward end, a first vertically movable weight resistance assembly associated in depending relationship to the rearward end of said boom, primary guide members carried on said boom and including at least a first rearward guide and a first forward guide, a first flexible connecting line having a rearward end fastened to said first weight assembly and a terminal forward end adapted to receive means for supporting the upper limb of a user patient, said first line having a portion extending upwardly from said first weight assembly and a portion guided along said horizontal boom by said primary guide members, a depending leg mounted in suspended condition to said frame, said boom being pivotally mounted at its rearward end to said depending leg for pivot swinging adduction and abduction movement of the boom in a horizontal plane about a generally vertical axis at said pivot mounting, and adjustable stop means associated with said boom pivot mounting for step-wise setting of stop limits for defining a selected range of adduction and abduction pivot swinging exercise movement of said boom during exercise use of said exercise assembly, wherein the relationship of said boom to said first depending weight resistance assembly is such that said pivot swinging movement of said boom is not transmitted to said first depending weight resistance assembly, and wherein the relationship of said first flexible connecting line to said pivot mounting of said boom is such that said first line never extends rearwardly of the vertical axis of said pivot mounting.

29. Exercise apparatus for supportively aiding a patient's therapeutic upper limb movements, comprising a skeletal frame and two exercise assemblies mounted on said frame, each said exercise assembly comprising a substantially horizontal boom having a rearward end and a forward end, a first vertically movable weight resistance assembly associated in depending relationship to the rearward end of said boom, primary guide members carried on said boom and including at least a first rearward guide and a first forward guide, a first flexible connecting line having a rearward end fastened to said first weight assembly and a terminal forward end adapted to receive means for supporting the upper limb of a user patient, said first line having a portion extending upwardly from said first weight assembly and a portion guided along said horizontal boom by said primary guide members, a depending leg to which said boom is pivotally mounted at its rearward end for pivot swinging adduction and abduction movement of the boom in a horizontal plane about a generally vertical axis at said pivot mounting, and adjustable stop means associated with said boom pivot mounting for step-wise setting of stop limits for the adduction and abduction extent of said pivot swinging movement of said boom, wherein said adjustable stop means comprises two plates mounted about the vertical axis of said pivot mounting of said boom, each said plate being rotationally adjustable about the axis of said pivot mounting and each said plate having a radial stop edge thereon, releasable locking means mounted on said boom for locking the rotational movement of said plates to the pivot swinging movement of said boom and for locking the position of the stop edge on one said plate relative to the stop edge on the other said plate, and stopping means mounted on said depending leg and projecting to a location between the radial stop edges of said plates, said stopping means being for stopping the movement of said boom when a said stop edge abuts said stopping means, wherein said stop edges form an angle therebetween that corresponds to the maximum angular extent of pivot swinging movement for said boom.

30. Exercise apparatus for supportively aiding a patient's therapeutic upper limb movements, comprising a skeletal frame and two exercise assemblies mounted on said frame, each said exercise assembly comprising a substantially horizontal boom having a rearward end and a forward end, a first vertically movable weight resistance assembly associated in depending relationship to the rearward end of said boom, primary guide members carried on said boom and including at least a first rearward guide and a first forward guide, a first flexible connecting line having a rearward end fastened to said first weight assembly and a terminal forward end adapted to receive means for supporting the upper limb of a user patient, said first line having a portion extending upwardly from said first weight assembly and a portion guided along said horizontal boom by said primary guide members, a depending leg to which said boom is pivotally mounted at its rearward end for pivot swinging adduction and abduction movement of the boom in a horizontal plane about a generally vertical axis at said pivot mounting, and adjustable stop means associated with said boom pivot mounting for step-wise setting of stop limits for the adduction and abduction extent of said pivot swinging movement of said boom, wherein said adjustable stop means comprises two plates mounted about the vertical axis of said pivot mounting of said boom for rotational adjustment movement thereabout, each said plate being equipped with a plurality of apertures radially spaced from the vertical axis of said pivot mounting such that rotational adjustment movement of said plates relative to each other permits registration of a said aperture in one said plate with a said aperture in the other said plate, and a locking pin mounted on said boom and adapted to retractably project through registered apertures of said plates.

31. The apparatus of claim 30 wherein said locking pin is biased toward a locking position within registered apertures of said plates.

32. Exercise apparatus for supportively aiding a patient's therapeutic upper limb movements, comprising a skeletal frame and two exercise assemblies mounted on said frame, each said exercise assembly comprising a substantially horizontal boom having a rearward end and a forward end, a first vertically movable weight resistance assembly associated in depending relationship to the rearward end of said boom, primary guide members carried on said boom and including at least a first rearward guide and a first forward guide, a first flexible connecting line having a rearward end fastened to said first weight assembly and a terminal forward end adapted to receive means for supporting the upper limb of a user patient, said first line having a portion extending upwardly from said first weight assembly and a portion guided along said horizontal boom by said primary guide members, a depending leg to which said boom is pivotally mounted at its rearward end for pivot swinging adduction and abduction movement of the boom in a horizontal plane about a generally vertical axis at said pivot mounting, and adjustable stop means associated with said boom pivot mounting for step-wise setting of stop limits for the adduction and abduction extent of said pivot swinging movement of said boom, wherein each said exercise assembly additionally comprises a second vertically movable weight resistance assembly associated in depending relationship to the rearward end of said boom, secondary guide members carried on said boom and including at least a second rearward guide and a second forward guide, said second forward guide being rearward of said first forward guide, and a second flexible connecting line having a rearward end fastened to said second weight assembly and a terminal forward end adapted to receive means for supporting the upper limb of a user patient, said second line having a portion extending upwardly from said second weight assembly and a portion guided along said horizontal boom by said secondary guide members, and wherein the relationship of said second flexible connecting line to said pivot mounting of said boom is such that said second line never extends rearwardly of the vertical axis of said pivot mounting.

33. The apparatus of claim 32 wherein one said connecting line is sense-wise distinguishable from the other said connecting line to thereby facilitate association between the rearward and forward ends of said one line and distinguish those ends from the rearward and forward ends of said other line.

34. Exercise apparatus for supportively aiding a patient's therapeutic upper limb movements, comprising a skeletal frame and two exercise assemblies mounted on said frame, each said exercise assembly comprising a substantially horizontal boom having a rearward end and a forward end, a first vertically movable weight resistance assembly associated in depending relationship to the rearward end of said boom, primary guide members carried on said boom and including at least a first rearward guide and a first forward guide, a first flexible connecting line having a rearward end fastened to said first weight assembly and a terminal forward end adapted to receive means for supporting the upper limb of a user patient, said first line having a portion extending upwardly from said first weight assembly and a portion guided along said horizontal boom by said primary guide members, a depending leg to which said boom is pivotally mounted at its rearward end for pivot swinging adduction and abduction movement of the boom in a horizontal plane about a generally vertical axis at said pivot mounting, and adjustable stop means associated with said boom pivot mounting for step-wise setting of stop limits for the adduction and abduction extent of said pivot swinging movement of said boom, wherein the depending legs of both exercise assemblies extend entirely in a transverse vertical plane and wherein each said exercise assembly is mounted on said skeletal frame at a horizontal axis so as to permit an adjustable degree of lateral tilt by said exercise assembly about said horizontal axis.

35. Exercise apparatus for supportively aiding a patient's therapeutic upper limb movements, comprising a skeletal frame and two exercise assemblies mounted on said frame, each said exercise assembly comprising a substantially horizontal boom having a rearward end and a forward end, a first vertically movable weight resistance assembly associated in depending relationship to the rearward end of said boom, primary guide members carried on said boom and including at least a first rearward guide and a first forward guide, a first flexible connecting line having a rearward end fastened to said first weight assembly and a terminal forward end adapted to receive means for supporting the upper limb of a user patient, said first line having a portion extending upwardly from said first weight assembly and a portion guided along said horizontal boom by said primary guide members, a depending leg to which said boom is pivotally mounted at its rearward end for pivot swinging adduction and abduction movement of the boom in a horizontal plane about a generally vertical axis at said pivot mounting, and adjustable stop means associated with said boom pivot mounting for step-wise setting of stop limits for the adduction and abduction extent of said pivot swinging movement of said boom, wherein said exercise assemblies are mounted on said skeletal frame so as to permit adjustment of the horizontal spatial distance between them.

36. Exercise apparatus for supportively aiding a patient's therapeutic upper limb movements, comprising a skeletal frame and two exercise assemblies mounted on said frame, each said exercise assembly comprising a substantially horizontal boom having a rearward end and a forward end, a first vertically movable weight resistance assembly associated in depending relationship to the rearward end of said boom, primary guide members carried on said boom and including at least a first rearward guide and a first forward guide, a first flexible connecting line having a rearward end fastened to said first weight assembly and a terminal forward end adapted to receive means for supporting the upper limb of a user patient, said first line having a portion extending upwardly from said first weight assembly and a portion guided along said horizontal boom by said primary guide members, a depending leg to which said boom is pivotally mounted at its rearward end for pivot swinging adduction and abduction movement of the boom in a horizontal plane about a generally vertical axis at said pivot mounting, and adjustable stop means associated with said boom pivot mounting for step-wise setting of stop limits for the adduction and abduction extent of said pivot swinging movement of said boom, wherein said adjustable stop means comprises an upper and a lower plate each having a pivot hole therein, each said plate having a plurality of apertures radially spaced from said pivot hole and having a stop edge radially extending from said pivot hole, the upper one of said plates being stacked upon the lower one of said plates with the vertical axis of said pivot mounting passing through the pivot holes of the stacked plates to permit pivot movement of each said plate independent of the pivot swinging movement of said boom, the stop edge of said upper plate and the stop edge of said lower plate forming a gap therebetween with the distance separating said stop edges defining the size of said gap, wherein pivot movement of said upper plate relative to said lower plate permits registration of a said aperture in said upper plate with a said aperture in said lower plate and permits the size of said gap to be adjusted, a retractable locking pin mounted on said boom at a location radially spaced from said vertical pivot axis and biased to project through a said aperture in said upper plate in registry with a said aperture in said lower plate to lock said plates against rotational movement with respect to each other, and a stop pin mounted on said depending leg at a location radially spaced from said vertical pivot axis and projecting into said gap to stop the pivot swinging movement of said boom when a said stop edge contacts said stop pin.

* * * * *